United States Patent [19]

Fritzenwenger

[11] 4,412,515

[45] Nov. 1, 1983

[54] LINE MULTICYLINDER INTERNAL COMBUSTION ENGINE

[75] Inventor: Josef Fritzenwenger, Anzing, Fed. Rep. of Germany

[73] Assignee: Bayerische Motoren Werke Aktiengesellschaft, Munich, Fed. Rep. of Germany

[21] Appl. No.: 155,661

[22] Filed: Jun. 2, 1980

[30] Foreign Application Priority Data

Jun. 2, 1979 [DE] Fed. Rep. of Germany ..... 2922695

[51] Int. Cl.[3] ..... F02B 77/14

[52] U.S. Cl. ..... 123/198 E; 123/41.10; 123/41.74; 123/195 HC; 123/198 C; 123/192 B

[58] Field of Search ..... 123/41.10, 41.74, 192 B, 123/195 R, 195 A, 195 AC, 195 C, 198 R, 198 C, 198 E, 59 R, 195 HC; 60/323

[56] References Cited

U.S. PATENT DOCUMENTS

| | | | |
|---|---|---|---|
| 2,669,322 | 2/1954 | Brown | 123/195 R |
| 2,677,357 | 5/1954 | Brubaker | 123/41.10 |
| 3,160,148 | 12/1964 | Giacosa et al. | 123/195 R |
| 4,117,673 | 10/1978 | Yamazaki et al. | 60/323 |
| 4,198,935 | 4/1980 | Seibt et al. | 123/195 A |
| 4,300,493 | 11/1981 | Berti | 123/192 B |

FOREIGN PATENT DOCUMENTS

| | | | |
|---|---|---|---|
| 2705090 | 8/1978 | Fed. Rep. of Germany | 123/195 A |
| 1234411 | 6/1971 | United Kingdom | 123/195 A |
| 289694 | 8/1973 | U.S.S.R. | 123/195 AC |

OTHER PUBLICATIONS

Weinert, Charles A., *Volkswagon Design and Production,* Automotive Industries, Aug. 15, 1961, p. 65.

*Primary Examiner*—Craig R. Feinberg
*Assistant Examiner*—W. R. Wolfe
*Attorney, Agent, or Firm*—Craig & Burns

[57] ABSTRACT

An in-line multicylinder internal combustion engine comprising an engine block including a cylinder crank housing having disposed therein a plurality of approximately horizontally disposed cylinders and a cylinder head mounted on the cylinder crank housing. An approximately horizontally disposed crankshaft is disposed in the cylinder crank housing for reciprocably displacing pistons in the respective cylinders, and an exhaust system is provided which begins at an underside of the cylinder head. A first housing cover is disposed on the cylinder head and extends in a longitudinal direction of the crankshaft with a second cover being disposed on the cylinder crank housing in an area of the crankshaft and extenging in a longitudinal direction thereof. The first and second housing covers each have essentially smooth lateral outer housing walls, with a cooling arrangement being mounted above an upper forward edge of the engine block. At least one first auxiliary unit for the engine is disposed on top of the engine block behind the cooling arrangement and a housing part is connected to and disposed below the cylinder crank housing. At least one second auxiliary unit for the engine is accommodated by the housing part. A part of the exhaust gas system extends next to the housing part with such part of the exhaust gas system being shaped as a housing member.

6 Claims, 10 Drawing Figures

LINE MULTICYLINDER INTERNAL COMBUSTION ENGINE

The present invention relates to an engine and, more particularly, to an in-line multicylinder internal combustion engine having an approximately horizontally disposed crankshaft and cylinders, with auxiliaries such as, for example, an air intake system, gear box, and the like being located partially on top and partially in a housing part connected below a cylinder crank housing, with the crankcase and valve chamber each having a housing cover, and with an exhaust system beginning at an underside of the cylinder head, a portion of which extends next to the housing part.

In German patent No. 956,384, a two-cylinder two-cycle internal combustion engine is proposed wherein a two-cylinder two-cycle internal combustion engine is adapted to be located inside a fairing of a motor scooter with the engine including a ducted housing for cooling the cylinders and a crankshaft mounted eccentrically and parallel to a normal direction of travel of the scooter. The proposed engine is not utilized in an exposed position on motorcycles which are largely not provided with a fairing or in stationary installations. In the latter applications, with all the auxiliary units attached or connected thereto, such an engine would present a highly irregular appearance which would be especially unpleasing in the case of motorcycles which by comparison conventionally have largely symmetrical arrangements.

In German Offenlegungsschrift No. 1,962,539 an internal combustion engine is proposed which is designed for enclosed installation transversely in motor vehicles. One long side of this proposed engine presents a highly fissured appearance which is completely different from the other side. With the exception of the intake and exhaust systems and the gearbox, this proposed engine construction offers no indication of any advantageous arrangement of other auxiliary units of the engine.

The aim underlying the present invention essentially resides in providing an internal combustion engine of the aforementioned type, especially for installation on motorcycles in an exposed position, with a crankshaft disposed lengthwise or longitudinally in such a fashion that, together with the auxiliary units, the engine presents a regular external appearance while nevertheless enabling good accessibility to engine parts and the auxiliary units.

In accordance with advantageous features of the present invention, when viewed in a lengthwise direction of the crankshaft, housing covers of the engine essentially have smooth lateral outer housing walls. Cooling devices such as, for example, a cooling air intake, liquid cooler, cooling air fan and cooling air ducting are mounted above an upper forward edge of the engine block, which consists essentially of the cylinder crank housing and the cylinder head. An additional part of the auxiliary unit such as, for example, a dynamo, starter, distributor, and intake system may be disposed on the top of the engine block behind the cooling devices. In addition to have a lubricating oil collecting chamber, the housing part includes additional auxiliaries such as, for example, an auxiliary drive shaft, balancing devices, a gearbox, distributor, lubricating oil filter, lubricating oil pumps, and coolant pumps. Moreover, a part of the exhaust gas system beneath the cylinder head and next to the housing part is constructed in the shape of a housing as an exhaust gas collector, exhaust gas muffler, exhaust gas reactor and/or exhaust gas pipe elbows with lateral shrouding resembling a housing.

By virtue of the above-noted features of the present invention, it is possible to achieve the above stated aim of the present invention to a suprisingly satisfactory degree. With a very smooth and largely symmetrical design for the engine, these features allow unimpeded access to nearly all engine parts after the housing covers are removed on both sides, as well as free access to all auxiliaries on the top and front as well as the bottom of the engine. Such accessibility of the auxiliary units is not substantially effected in a negative fashion if additional removable fairing elements, especially in motorcycles equipped with partial fairing, extend upward as far as a tank or saddle or frame parts located above, in addition to front mounted cooling equipment and the lateral housing covers.

Moreover, with an exhaust system constructed as a thermal or catalytic reactor, such system can be mounted directly on the bottom openings of the exhaust pipes from the cylinder head thereby permitting favorable working conditions for the functioning of the exhaust gas after treatment. Moreover, the radiating surfaces of long, exposed exhaust pipes running through a muffler can be practically eliminated thereby so as to result in a considerable reduction of noise radiation. Finally, the relatively high location of the cooling devices reduces their contamination during operation of the engine in a motor vehicle.

In accordance with further advantageous features of the present invention, the two lateral housing covers extend approximately over an entire height of the crankcase and a valve chamber of the cylinder head which accommodates valve control elements. Despite the essential asymmetry of the basic components, these features nevertheless produce a largely symmetrical appearance for the engine.

To ensure a structurally simple and efficient return of lubricating oil from the crankshaft to the oil sump, in accordance with the present invention, an oil wiping edge is provided on a cylinder crank housing, parallel to a lower sealing surface for the housing cover to the crankcase, and a slot-shaped oil return opening, subdivided by reinforcing ribs, is located between the sealing surface and the oil wiping edge.

Connecting points or connecting lugs for a connection to a bearing frame and/or motorcycle frame are provided on the engine block in the vicinity of the upper corner points which are each in the immediate vicinity of the housing covers on both sides so as to arrive at an arrangement of connecting points for the engine mount on a broad basis.

By appropriate dimensioning and arranging of the housing parts and auxiliary units, it is possible to contribute further to a rounding off of the external appearance of the engine. In this connection, the housing part, located beneath the cylinder crank housing, and a part of the exhaust gas system which is located next to it, may extend jointly for approximately an entire length and width of the engine block deliminted by separating planes of the housing covers. Moreover, the lower housing part may comprise additional auxiliaries at its forward end such as, for example, the lubricating oil filter, lubricating oil pump, distributor and coolant pump.

Additionally, with a liquid cooled internal combustion engine, the liquid cooler or radiator with a fan, and/or cooling air guides or shrouds may be located on the top of the internal combustion engine in front of and on both sides of the additional auxiliary units located thereon. In addition to the improved noise insulation which is provided by using liquid cooling, these last mentioned features also provide for a flow favoring cooling air ducting which is protected against excessive contamination and also avoids an overheating of the auxiliary units.

To realize a space saving arrangement of the lubricating oil pump and coolant pump in the engine housing, a pump impeller of the lubricating oil pump, constructed as a gear pump, and an impeller of the coolant pump, designed as a circulating pump, are mounted on a common pump shaft, and such pump shaft includes a driving connection to a crankshaft which driving connection is located inside the housing part. The lubricating oil pump is located inside the housing part and the coolant pump is located on the outside of the front wall of the housing part.

To provide for a spatially favorable arrangement of an auxiliary drive shaft and likewise a spatially favorable arrangement of the engine output shaft, approximately in a longitudinal center plane of the engine, in accordance with still further features of the present invention, the auxiliary drive shaft is located immediately below the cylinders in the housing part connected thereto and an end of the auxiliary drive shaft, which is driveably connected to one end of the crankshaft, constitutes a power takeoff from the internal combustion engine by way of, for example, a drive flange. As a further improvement of the above-noted features, utilizing two or three cylinders, in order to make the engine essentially vibration free, in accordance with the present invention, one balancing device is provided, which device consists of balancing weights mounted on the auxiliary drive shaft so that a 1:1 driving connection exists with reversal of direction, between the crankshaft and auxiliary drive shaft.

In order to provide for a more favorable space and drive standpoint for the arrangement and construction of the pump drive, in accordance with the present invention, the auxiliary drive shaft is in driving connection with the pump shaft with the pump shaft being driven through a spur gear drive. The gears are located on the inside of a wall of the housing part, each of which has one bearing of the auxiliary drive shaft and pump shaft. The lubricating oil pump is located on an outside of this wall and abuts a housing of the coolant pump. A drain opening, a shaft sealing ring, and another bearing for the pump shaft, as well as the pump spiral housing, pump impeller, and connecting stump for a pump cover and oil filter housing are also provided.

To provide for an advantageous construction for the driving connection between the crankshaft and the electrical auxiliary units, whereby the arrangement of these auxiliary units on the top of the engine produces especially favorable access for maintenance, an additional auxiliary shaft, driven by the same end of the crank shaft, is located directly above the cylinders. The shaft is provided with a starting spur gear in a vicinity of its drive gear and is driveably connected with the dynamo. A helical gear drive for the distributor is provided whereby the dynamo is located as an axial drive-side extension of the auxiliary shaft. The starter, parallel to the auxiliary shaft, has its drive or starting gear on the drive side end of the auxiliary shaft and the distributor is located at right angles to the auxiliary shaft, with an angle drive and is aligned vertically upward in a vicinity of a free end of the auxiliary shaft.

To realize yet an additional savings of space, in accordance with still further features of the present invention, the starter is located in a niche-shaped depression of the engine block with a bottom of the depression being formed by an outside wall of the cylinder-cooling jacket and side walls are formed by a part of the cylinder-crank housing which encloses the auxiliary shaft, by a flange wall of the cylinder-crank housing for mounting the starter by a part of the cylinder-crank housing which contains a cooling duct, and by an upper part of the cylinder head which contains intake and cooling ducts.

To provide for an especially advantageous adaptation of the drive gearing for a four cycle engine with three cylinders so as to attain a favorable high rpm for the dynamo, a regular ignition triggering is provided for the distributor with a uniform of 240° ignition spacing for the individual cylinders, with the correct half rmp of the crankshaft for a triple distributor. The drive gear ratio for the auxiliary shaft is 1.5:1 with an ignition signal former near a component, for example, the starter gear, which turns together with the auxiliary shaft and a drive gear ratio of 1:3 of the angle drive of the distributor constructed as a triple distributor. These features may be used independently if not incorporated in a three-cylinder four-cycle in-line internal combustion engine.

In order to provide a construction for the liquid cooling and its control by a mixing thermostat with a low manufacturing cost for the lines and the line connections, a thermostat housing for by-pass control of the coolant is located on a top of the engine block as an additional auxiliary unit. The thermostat housing includes a mixing thermostat and is constructed with one valve each for a short circuit or by-pass between one motor outlet opening and a coolant pump, and for a connection between a radiator return line and the coolant pump. The thermostat housing includes a connection of a radiator return line and a mixing chamber. In a coolant duct to the coolant pump and an opening of the short circuit terminate, which are formed in or on the engine block. A thermostatic insert is located in the mixing chamber, with the insert including a valve for the opening provided on the thermostat housing of the radiator return line and a valve closing part for opening of the short circuit or by-pass which is provided on the engine block.

Advantageously, the opening of the by-pass and the opening of the coolant duct to the coolant pump are adjacent to an opening on the engine block for a radiator fore-line. The opening of the by-pass and opening of the coolant duct terminate in the mixing chamber of the thermostat housing and the opening for the radiator fore-line terminates in a connecting stub for the radiator fore-line which is formed in the one piece thermostat housing.

Advantageously, the coolant pump is mounted at the forward end of the lower housing part with the coolant ducts being mounted so as to run from the coolant pump in the engine block, lead to a forward inlet opening of the cylinder cooling jacket. A cylinder head cooling jacket, connected with the cylinder cooling jacket, is provided in the rear area above the opening of the by-pass and opening for the radiator fore-line. The coolant duct runs back from the mixing chamber of the thermostat housing, beginning with the opening inside the cylinder head on the top of the cylinder head cooling jacket to the forward end of the engine block and from there into the additional cooling ducts, located in the housing parts back to the coolant pump.

The coolant ducts surrounds, approximately in an annular shape, openings such as inlet ducts and housing recesses which terminate on the top of the cylinder head.

In accordance with still further features of the present invention, a one piece thermostat housing is mounted on a connecting surface of the engine block for by-pass control of the coolant in a releasable fashion. The termostat housing surrounds the thermostatic insert with a valve for a coolant line, i.e., radiator return line, to the radiator and has a stub for such coolant line. Openings provided in the connecting surface terminate in an interior or mixing chamber of the thermostatic housing serving as a by-pass parallel to the radiator or as a connecting stub for an additional coolant line such as a coolant duct to the coolant pump. An additional opening is provided in the connecting surface and is associated with the thermostat housing.

A connection, formed on the thermostat housing, for a coolant line such as the radiator fore-line from or to the liquid cooler or radiator cooperates with the additional opening.

As can readily be appreciated, the above-noted features of the liquid cooling and its control by a mixing thermostat can also be independently used on an internal combustion engine of different basic designs.

Accordingly, it is an object of the present invention to provide an internal combustion engine which avoids, by simple means, shortcomings and disadvantages encountered in the prior art.

Another object of the present invention resides in providing an internal combustion engine adapted to be installed on a motorcycle which meets the requirements of low manufacturing costs and weight, low noise radiation, convenient construction of the exhaust system, a low center of gravity, as well as a narrow width for good riding characteristics and to provide large tilt angles for motorcycles.

A still further object of the present invention resides in providing an internal combustion engine which, when used with motorcycles, with or without fairings, both the external smooth and symmetrical design and low center of gravity as well as a favorable arrangement and accessibility of all the principle and auxiliary systems are advantageously obtained.

Yet another object of the present invention resides in providing an internal combustion engine which utilizes a liquid cooling so as to produce low noise radiation.

A further object of the present invention resides in providing an internal combustion engine which enables the utilization of a compact exhaust gas system to produce low amounts of contaminants in the exhaust.

Yet another object of the present invention resides in providing an internal combustion engine which, during operation, creates favorable conditions which make it possible to meet even the higher requirements in the area of exhaust emissions which will be imposed in the future.

Another object of the present invention resides in providing an internal combustion engine which functions realiably under all operating conditions.

A still further object of the present invention resides in providing an in-line, three-cylinder four-cycle internal combustion engine with horizontal cylinders which engine is constructed, in particular, for installation lengthwise in motorcycles, with a crankshaft which is located in a direction of travel of the motorcycle.

Yet another object of the present invention resides in providing an in-line, three-cylinder, four-cycle internal combustion engine which is readily adapted to be used in motor vehicles and mobile as well as stationary machines.

These and other objects, features, and advantages of the present invention will become more apparent from the following description when taken in connection with the accompanying drawings which show, for the purposes of illustration only, one embodiment of an in-line, three-cylinder, four-cycle internal combustion engine with horizontal cylinders, adapted, in particular, for installation in a motorcycle, and wherein.

Figure 1:
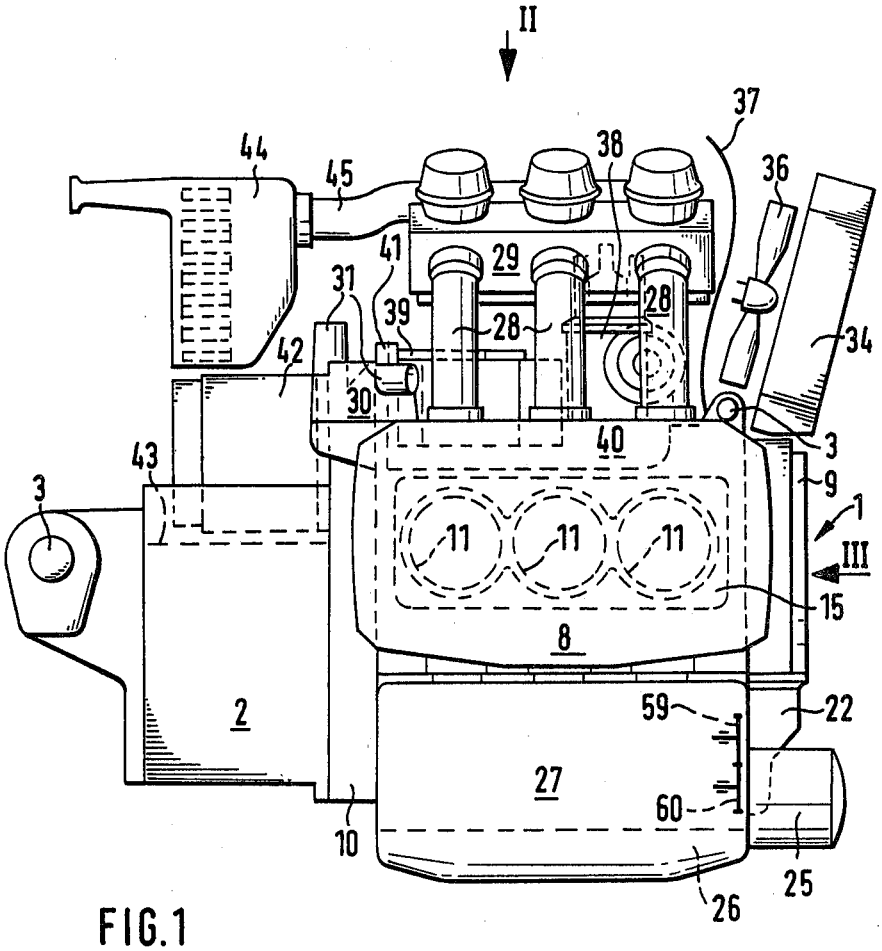
FIG. 1 is a partially schematic side view of an internal combustion engine with auxiliary units in a flanged gear box arranged thereon with a ready-to-install transmission.

Referring now to the drawings wherein like reference numerals are used throughout the various views to designate like parts and, more particularly, to FIG. 1, according to this figure, an internal combustion engine generally designated by the reference numeral 1 is equipped with a flanged gear box 2 and is provided with one mounting lug 3 at a forward and rear upper corner point for enabling a connection of the engine 1 to a vehicle or machine frame (not shown).

Figure 2:
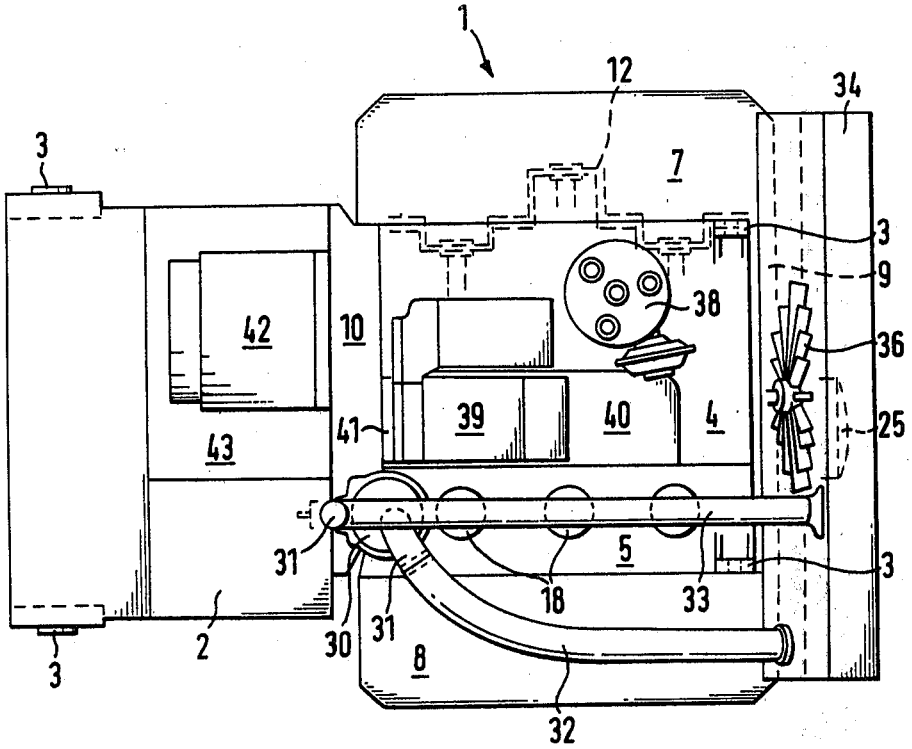
FIG. 2 is a top view taken in the direction of arrow II in FIG. 1 with an intake manifold of the engine removed.
Figure 3:
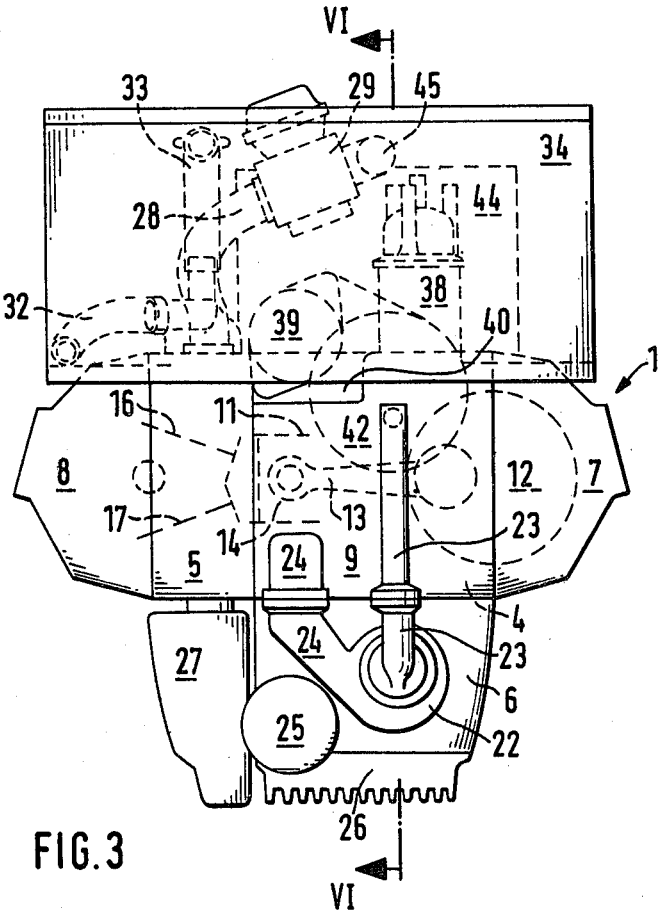
FIG. 3 is an end view taken in the direction of the arrow III in FIG. 1.

As apparent, especially from FIGS. 1–3, the main components of the internal combustion engine 1 include a cylinder and crank housing 4, a cylinder head 5, and a housing part 6, mounted beneath the cylinder crank housing 4. Together with housing covers 7, 8 provided on respective sides of the engine 1, a front control cover 9, and a rear flanged cover 10, these components form the engine block of the internal combustion engine 1.

As shown most clearly in FIGS. 1 and 3, the cylinder crank housing includes three horizontal cylinders 11 in which pistons 14 are guided, with the pistons 14 being reciprocably driven by a crankshaft 12 through connecting rods 13. The cylinders 11 have a cylinder cooling jacket 15 for liquid cooling. The cylinder head 5 is provided with one pair of intake and exhaust valves 16, 17 for each cylinder 11 for controlling intake and exhaust ducts 18, 19. For this purpose, as shown most clearly in FIG. 7, a valve chamber 20 of the cylinder head 5, sealed by the housing cover 8, contains valve control elements, namely, rocker levers 21', driven by a cam shaft 21. The cylinder head 5 also contains cooling ducts which constitute a cylinder head cooling jacket 15' and which communicate with the cylinder cooling jacket 15.

To guide coolant to and from a coolant pump generally designated by the reference numeral 22, mounted at the front of the engine, coolant ducts 23 and 24 are shaped to fit the housing of the coolant pump 22, control cover 9, and cylinder head 5. In addition to the coolant pump 22, the housing part 6 supports an oil filter housing 25 which is likewise mounted at the front of the engine 1. An underside of the housing part 6 is constructed as a removable ribbed oil pan generally designated by the reference numeral 26, with a slot-shaped oil return opening 4' (FIG. 8), subdivided by reinforcing ribs, being provided on the cylinder crank housing 4 for the return of lubricant from a rotation area of the crankshaft 12 to the oil pan 26. The slot-shaped oil return opening 4' is provided with an oil wiping edge 4" (FIG. 8) extending parallel to a lower edge of the housing cover 7 for the crankcase.

Figure 8:
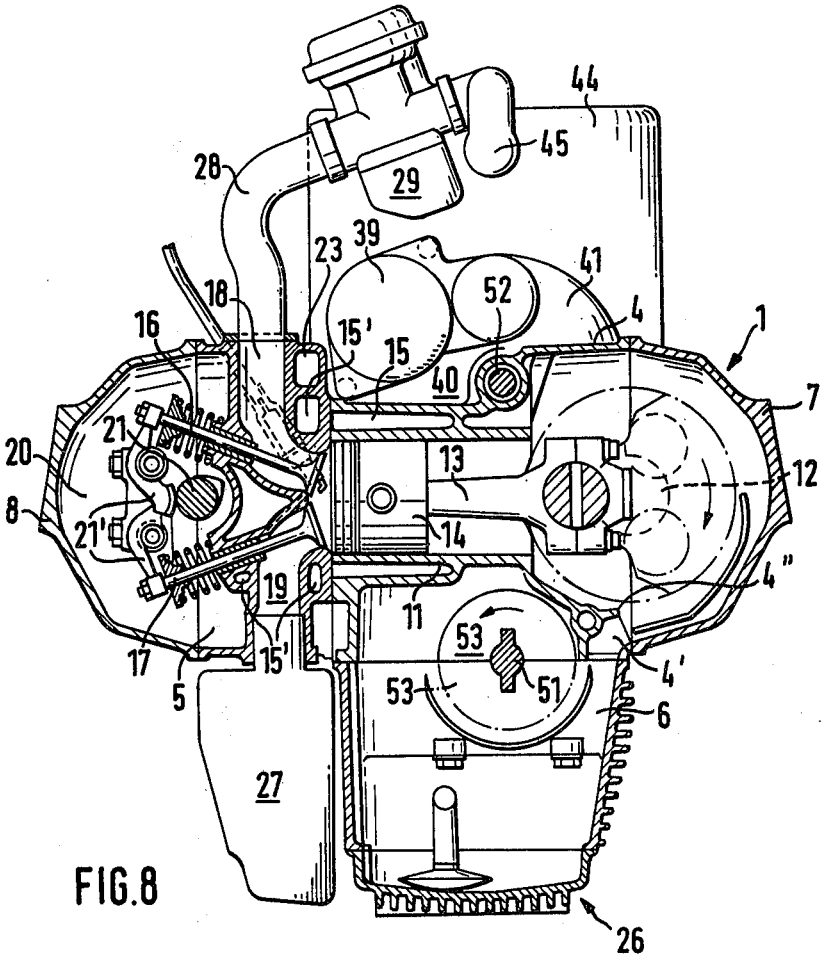
FIG. 8 is a vertical cross sectional view taken along the line VIII—VIII in FIG. 6.

As shown most clearly in FIGS. 1, 3, and 8, an exhaust system 27, in the form of a housing, is mounted laterally next to the housing part 6 and oil pan 26 on an underside of the cylinder head 5 and communicates with the exhaust ducts 19 terminating thereat. The lateral outside contour of the exhaust system 27 has a shape which roughly corresponds, for reasons of symmetry, to the opposite outside contour of the housing part 6 and oil pan 26. The outside contours on both sides then extend into the housing cover 7 and 8, which likewise have contours that correspond to one another so that the overall result is a corresponding and/or mirror image outside contour of the internal combustion engine 1 on both sides.

Most of the auxiliary units of the engine 1 are carried at the top thereof. For example, carburetors 29 are connected and mounted to the top of the engine 1 and communicate with intake ducts 18 of the cylinder head 5 through intake lines 28 (FIG. 1).

Figure 9:
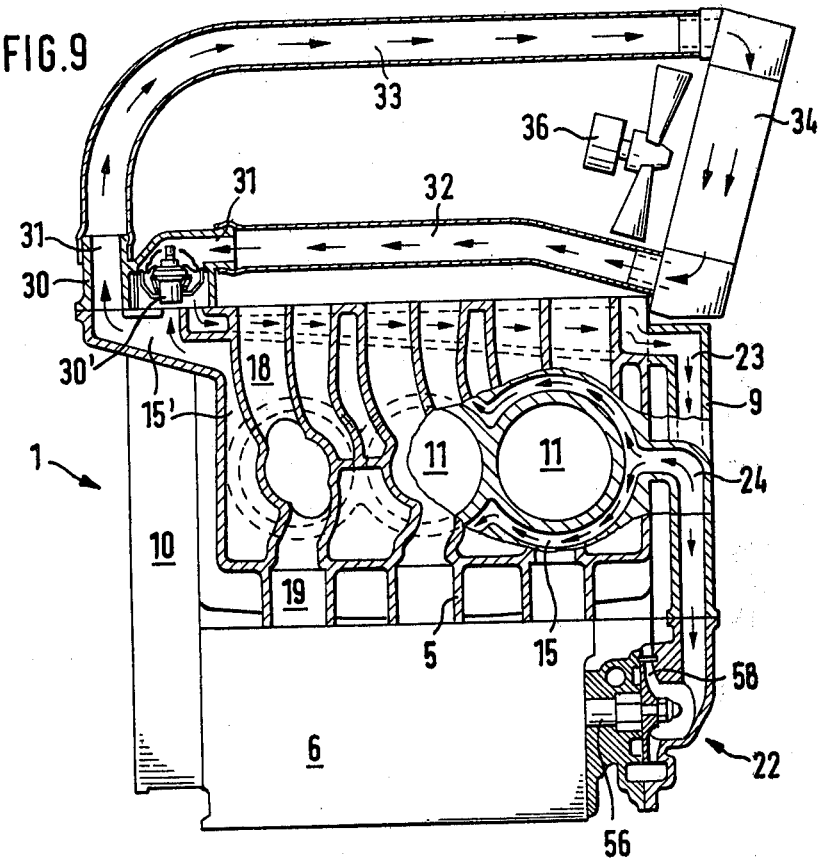
FIG. 9 is a schematic representation of the cooling system of the internal combustion engine of FIG. 1.
Figure 10:
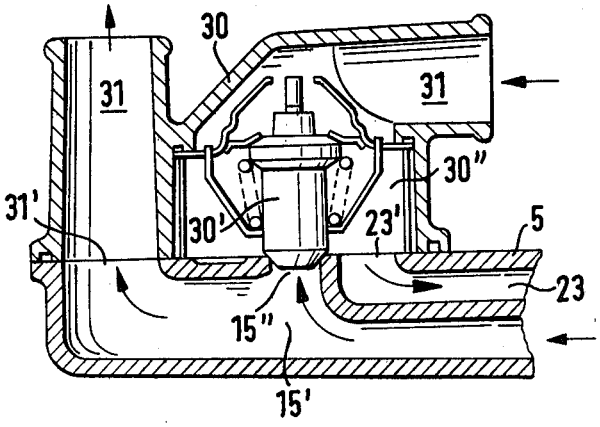
FIG. 10 is a cross sectional view through a portion of the cooling system of FIG. 9 in a vicinity of the thermostat.

As shown most clearly in FIGS. 9 and 10, a thermostat housing 30, with a thermostatic insert 30' accommodated therein and connections 31 for coolant lines 32, 33 extending from and to a radiator or cooler 34, is located on the top of the cylinder head 5. Through openings 15", 23' and 31' are provided in the cylinder head 5 and cylinder head jacket 15' so as to form a short circuit or by-pass 15" to a mixing chamber 30" of the thermostat housing 30, with the thermostat housing 30 being connected by coolant duct 23 to the coolant pump 22 and the cylinder head jacket 15' being connected by a connection 31 through coolant line 33 with the radiator or cooler 34.

Figure 6:
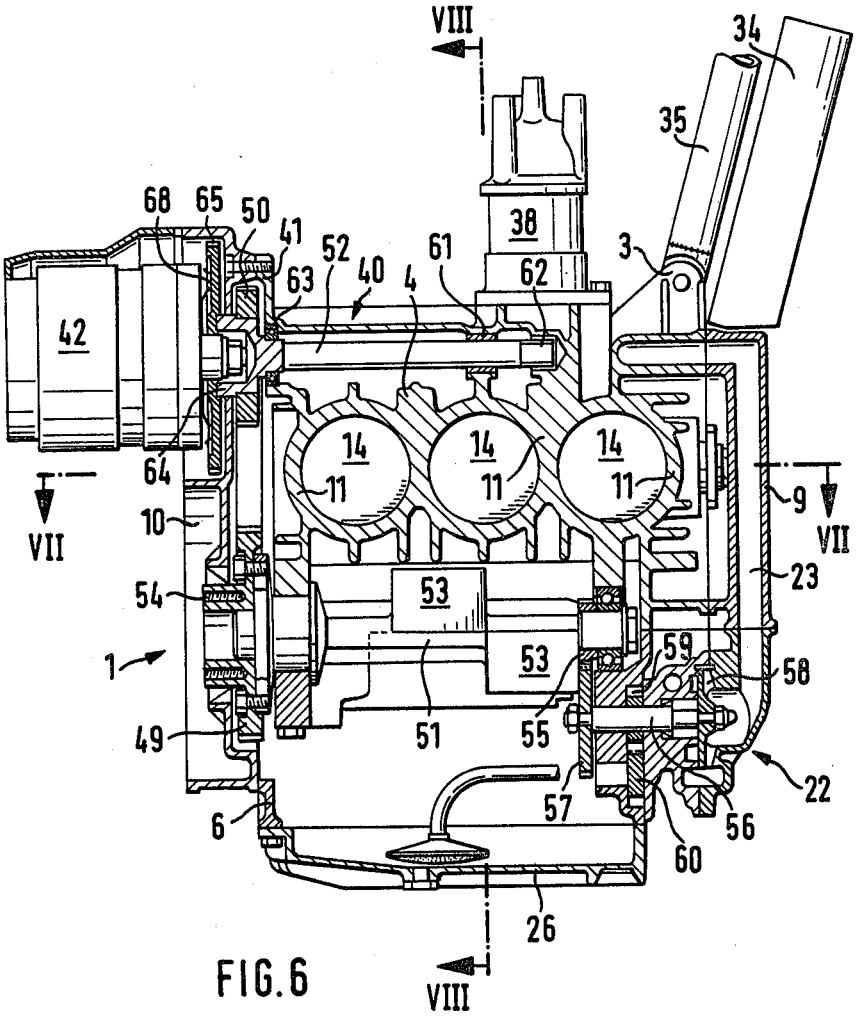
FIG. 6 is a vertical longitudinal section taken along the line VI—VI in FIG. 3 with the transmission of the engine removed.

The radiator or cooler 34 is connected to an upper side of the internal combustion engine 1 near its forward upper edge and is tilted slightly away from the engine whereby it is adapted to the arrangement of motorcycle frame tubes 35 (FIG. 6) which are likely usually inclined. The tubes 35 are adapted to be connected to the mounting lugs 3. As shown in FIG. 3, the radiator or cooler 34 extends laterally approximately over an entire width of the internal combustion engine 1, and extends vertically approximately as far as the level of the carburetors 29, mounted at the top of the internal combustion engine 1, which carburetors 29 are the auxiliary units which project the furthest vertically outwardly from the engine 1.

When installed in a motorcycle, the radiator or cooler 34 may extend up to a vicinity of the front fork (not shown) of the motorcycle. A shroud 37 for the cooling air, which prevents the heated cooling air from the radiator or cooler 34 from having any disadvantageous effect upon the auxiliary units located behind it is interposed between the radiator 34 and carburetors 29. As shown most clearly in FIG. 1, a fan 36 is interposed between the shroud 37 and the radiator or cooler 34.

As shown in FIGS. 1–3 and 6, a distributor 38 and a starter 39 are mounted as additional auxiliary units on the top of the internal combustion engine 1. To save space, the starter 39 is located partially in a niche-shaped depression 40, surrounded by housing walls of the cylinder-crank housing 4 and cylinder head 5. The starter 39 is mounted to a flanged wall 41, shaped to fit a rear upper edge of the cylinder-crank housing 4. The rear flange cover 10 abuts the flange wall 41, with the cover 10 supporting a dynamo 42 which is laterally displaced relative to the starter 39 and projects rearwardly. So as to save space, the dynamo 42 is likewise arranged partially set into an upper recess 43 of the housing for the transmission 2. An air filter and air intake muffler 44, connected through a line 45 with carburetors 29, is mounted above the dynamo 42.

Figure 4:
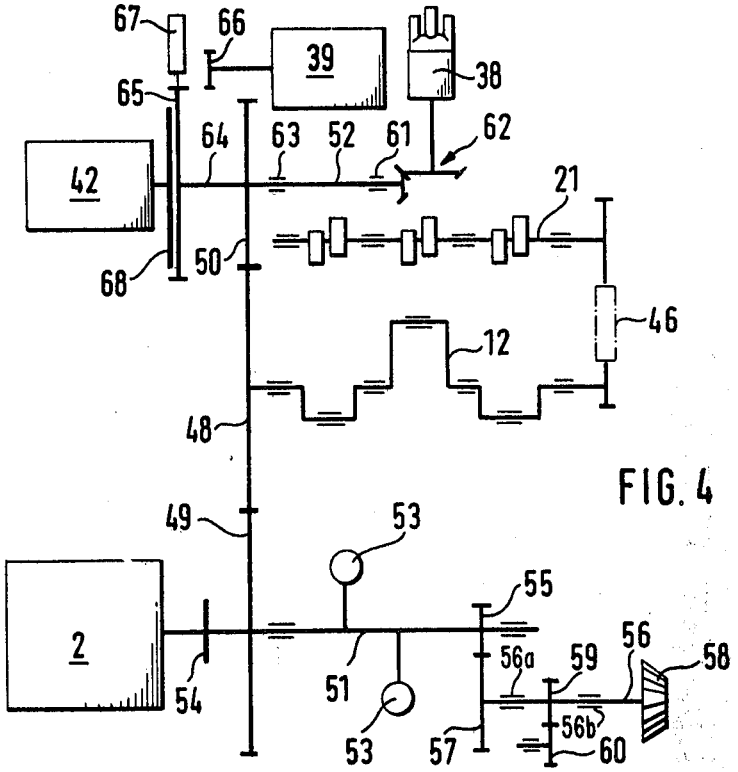
FIG. 4 is a schematic shaft diagram of the transmission arrangement of the internal combustion engine in accordance with the present invention.
Figure 5:
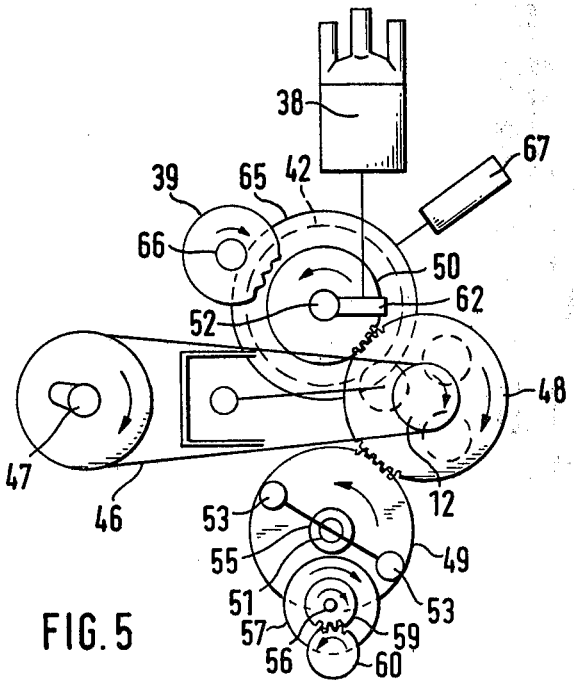
FIG. 5 is a partially schematic diagram of the transmission arrangement of the internal combustion engine in an end view corresponding to the end view of FIG. 3.
Figure 7:
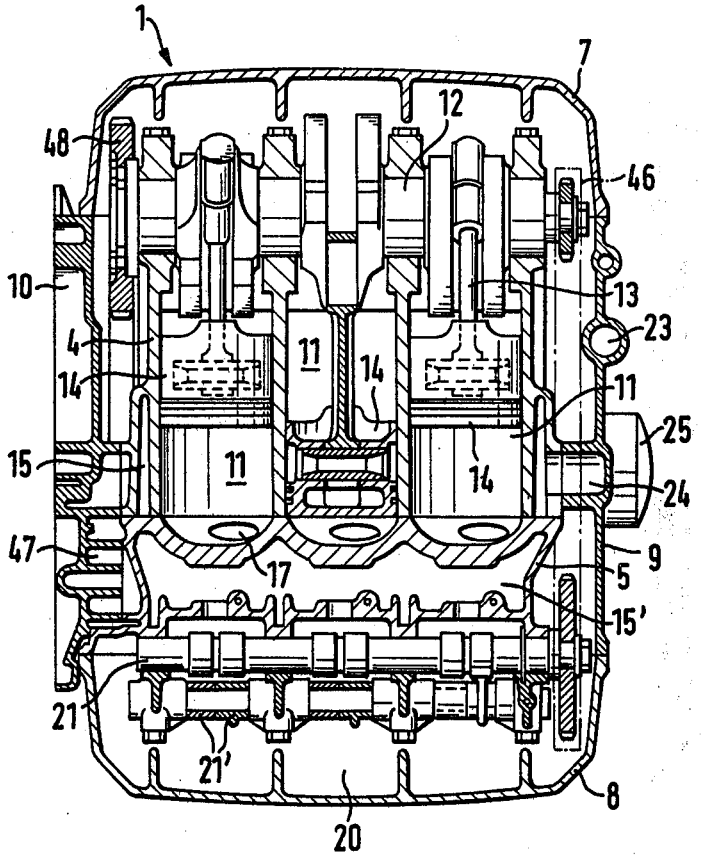
FIG. 7 is a horizontal longitudinal section taken along the line VII—VII in FIG. 6.

FIGS. 4 and 5 in particular show the internal construction of the internal combustion engine 1 of the present invention and, more particularly, according to these figures, the crankshaft 12 is driveably connected with a cam shaft 21 by a chain or toothed belt 46. This drive is located interiorly of the front control housing 9 (FIGS. 1–3). A vent housing 47 is located opposite on the cylinder head 5 and is made partially integral with the rear flange cover 10 (FIG. 7). The crankshaft 12 has a spur gear 48 mounted on an end which faces the transmission 2. The spur gear meshes with a gear 49 in a driving ratio of 1:1 and a gear 50 in a driving ratio of 1.5:1. By means of these gears 49, 50, on the one hand, auxiliary drive shaft 51 and, on the other hand, auxiliary drive shaft 52 may be driven in a rotational direction which is opposite to that of the crankshafts 12.

The auxiliary drive shaft 51 is provided with balance weights 53 to balance the torques generated by the three-cylinder design of the engine 1, a drive flange 54 for the driving connection to the transmission 2, on the side of the gear 49 which faces the transmission 2, and a take-off gear 55 of a spur gear drive for a pump shaft 56 at the opposite end. The pump shaft 56 has a drive gear 57 at one end as a component of the spur gear drive for the pump shaft 56 while, at the other end thereof, a pump impeller 58 of the coolant pump 22 is provided, with one of two pump impellers 59, 60 of a lubricating oil gear pump being disposed centrally between two bearings 56*a*, 56*b* for the pump shaft 56.

A bearing 61 is provided for the auxiliary shaft 52 at an end thereof which is on a side of the drive for the cam shaft 21. A drive wheel of a 1:3 angular or bevel drive transmission generally designated by the reference numeral 62 for the distributor 38, designed as a triple distributor, is provided at the end of the auxiliary drive shaft 52. Mounted on a far side of the gear 50, which is mounted outside of a second bearing 63 for the auxiliary shaft 52, the auxiliary shaft 52 is provided with a starter spur gear 65 adapted to engage a starter pinion 66. An ignition signal former 67 is also connected with teeth of the starter spur gear 65 with the distributor 67, for this purpose, being disposed radially with respect to the starter spur gear 65. Additionally, the dynamo 42 is connected to the starter spur gear 65 by a friction clutch 68.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An internal combustion engine comprising an engine block including a cylinder-crank housing means having disposed therein a plurality of approximately horizontal cylinders and a cylinder head mounted on the housing means, a piston means reciprocally mounted in each cylinder, an approximately horizontally disposed crank shaft means for reciprocally displacing the piston means in the respective cylinders, a housing part connected to and disposed below the cylinder-crank housing means, an exhaust system beginning at an underside of the cylinder head, a part of the exhaust system extending next to said housing part, a first housing cover means disposed on the cylinder head and extending in a longitudinal direction of the crank shaft means, a second housing cover means disposed on the cylinder-crank housing means in an area of the crank shaft means and extending in a longitudinal direction of the crank shaft means, said first and second housing cover means each have essentially smooth lateral outer housing walls and together with the housing part on one side and said part of the exhaust gas system on the other side form the outer side limitations of the whole engine, the cylinder-crank housing means further includes an oil wiping edge extending parallel to a lower sealing surface for sealing the second housing cover means to the cylinder-crank housing means, and a slot-shaped oil return opening being located between the sealing surface and the oil wiping edge, said slot-shaped oil return opening is subdivided by reinforcing ribs.

2. An internal combustion engine comprising an engine block including a cylinder-crank housing means having disposed therein a plurality of approximately horizontal cylinders and a cylinder head mounted on the housing means, a piston means reciprocally mounted in each cylinder, an approximately horizontally disposed crank-shaft means for reciprocally displacing the piston means in the respective cylinders, a housing part connected to and disposed below the cylinder-crank housing means, an exhaust system beginning at an underside of the cylinder head, a part of the exhaust system extending next to said housing part, a first housing cover means disposed on the cylinder head and extending in a longitudinal direction of the crank shaft means, a second housing cover means disposed on the cylinder crank housing means in an area of the crank shaft means and extending in a longitudinal direction of the crank shaft means, means for cooling the engine mounted on the front end of the engine above an upper forward edge of the engine block, at least one first auxiliary unit for the engine disposed on top of the engine block behind the cooling means, at least one second auxiliary unit for the engine accommodated by the housing part, said second auxiliary units including a lubricating oil pump and a coolant pump, each of which are disposed at a forward end of the housing part connected below the cylinder-crank means, the lubricant oil pump is a gear pump and includes a pump impeller, the coolant pump is a circulating pump and includes an impeller, the impeller of the lubricating oil pump and the impeller of the coolant pump are mounted on a common pump shaft, means are provided inside the housing part connected below the cylinder-crank housing means for drivingly connecting the pump shaft to the crank shaft means, and the lubricating oil pump being located inside said housing part and the coolant pump being located outside a front wall of the housing part.

3. An internal combustion engine comprising an engine block including a cylinder-crank housing means having disposed therein a plurality of approximately horizontal cylinders and a cylinder head mounted on the housing means, a piston means reciprocally mounted in each cylinder, an approximately horizontally disposed crank shaft means for reciprocally displacing the piston means in the respective cylinders, a housing part connected to and disposed below the cylinder-crank housing means, an exhaust system beginning at an underside of the cylinder head, a part of the exhaust system extending next to said housing part, a first housing cover means disposed on the cylinder head and extending in a longitudinal direction of the crank shaft means, a second housing cover means disposed on the cylinder-crank housing means in an area of the crank shaft means and extending in a longitudinal direction of the crank shaft means, means for cooling the engine mounted on the front end of the engine above an upper forward edge of the engine block, at least one first auxiliary unit for the engine disposed on top of the engine block behind the cooling means, at least one second auxiliary unit for the engine accommodated by the housing part, a first auxiliary drive shaft being located in the housing immediately below the cylinders, means are provided for drivingly connecting one end of the auxiliary drive shaft to one end of the crank shaft means, a drive flange means is provided on said one end of said first auxiliary drive shaft for forming a power take-off from the engine, a second auxiliary shaft is located in the cylinder crank housing means directly above the cylinders, driving means are provided for drivingly connecting said second auxiliary shaft with said crank shaft means, a starting spur gear being provided at one end of the second auxiliary shaft in the vicinity of said driving means, the second auxiliary shaft driving a dynamo which forms one of the first auxiliary units disposed on the top of the engine, and said starting gear being disposed on a portion of the second auxiliary shaft extending beyond the means for drivingly connecting the same with the crank shaft means.

4. The internal combustion engine according to claim 3, wherein a starter forms a first auxiliary unit disposed on the top of the engine, and the starter being disposed and parallel to the second auxiliary shaft and including a starting gear disposed on a drive side end of the second auxiliary shaft.

5. The internal combustion engine according to claim 4, wherein intake and cooling ducts are provided in an upper part of the cylinder head and in a cylinder cooling jacket, the engine block includes a depression for accommodating the starter, a bottom of said depression being formed by an outside wall of the cylinder cooling jacket, and side walls of the depression are formed by a portion of the cylinder-crank housing means enclosing the second auxiliary shaft, a flanged wall of the cylinder-crank housing means and a further portion of the cylinder crank housing means.

6. The internal combustion engine according to claim 5, wherein the starter is adapted to be mounted on the flanged wall of the cylinder-crank housing means.

* * * * *